US008262516B2

(12) United States Patent
Fuentes

(10) Patent No.: US 8,262,516 B2
(45) Date of Patent: Sep. 11, 2012

(54) SPORT TRAINING APPARATUS

(76) Inventor: Jose Fuentes, Aptos, CA (US)

( * ) Notice: Subject to any disclaimer, the term of this patent is extended or adjusted under 35 U.S.C. 154(b) by 0 days.

(21) Appl. No.: 12/313,578

(22) Filed: Nov. 21, 2008

(65) Prior Publication Data

US 2010/0130312 A1 May 27, 2010

(51) Int. Cl.
*A63B 69/00* (2006.01)

(52) U.S. Cl. ..... 473/429; 473/422; 473/423

(58) Field of Classification Search ..... 473/422–425, 473/427, 429, 438, 506; 273/331, 334, 335, 273/393
See application file for complete search history.

(56) References Cited

U.S. PATENT DOCUMENTS

| | | | | | |
|---|---|---|---|---|---|
| 124,915 | A | * | 3/1872 | Rix | 473/575 |
| 2,199,461 | A | * | 5/1940 | Jones | 473/576 |
| 2,751,226 | A | * | 6/1956 | Conway | 473/427 |
| 3,351,343 | A | * | 11/1967 | Papp | 473/430 |
| 3,498,613 | A | * | 3/1970 | Dreyer | 473/575 |
| 3,547,437 | A | * | 12/1970 | Andersen | 473/427 |
| 3,709,491 | A | * | 1/1973 | Minchin | 473/575 |
| 4,147,353 | A | * | 4/1979 | Moore | 473/575 |
| 4,616,834 | A | * | 10/1986 | Davis | 473/429 |
| 4,687,209 | A | * | 8/1987 | Carey | 473/424 |
| 4,989,877 | A | * | 2/1991 | Bias | 473/149 |
| 5,280,922 | A | | 1/1994 | Jones | |
| 5,435,572 | A | | 7/1995 | Covel | |
| 5,531,438 | A | * | 7/1996 | Corley | 473/429 |
| 5,553,848 | A | * | 9/1996 | Amron | 473/416 |
| 5,611,539 | A | * | 3/1997 | Watterson et al. | 473/197 |
| 5,823,895 | A | | 10/1998 | Rasic | |
| 5,882,270 | A | * | 3/1999 | Daugherty | 473/427 |
| 5,957,789 | A | * | 9/1999 | Ainscough et al. | 473/423 |
| 6,024,657 | A | * | 2/2000 | Bettencourt, Jr. | 473/427 |
| 6,220,974 | B1 | | 4/2001 | Moore | |
| 6,352,484 | B1 | | 3/2002 | Killion | |
| 6,475,108 | B1 | | 11/2002 | Sarenana, Sr. et al. | |
| 6,716,119 | B1 | | 4/2004 | Weisz et al. | |
| 6,773,365 | B2 | * | 8/2004 | Wilson | 473/449 |
| D506,233 | S | | 6/2005 | Cruz | |
| 7,226,373 | B2 | * | 6/2007 | Arenas | 473/417 |
| D563,495 | S | | 3/2008 | Torres | |
| 7,364,517 | B1 | * | 4/2008 | Johnsen | 473/446 |
| 7,775,913 | B2 | * | 8/2010 | Woods | 473/430 |
| 2010/0105505 | A1 | * | 4/2010 | Norman | 473/575 |

* cited by examiner

*Primary Examiner* — Mitra Aryanpour
(74) *Attorney, Agent, or Firm* — Patrick Reilly; Colin Fowler

(57) ABSTRACT

A device is disclosed to improve the accuracy of a sport participant in the kicking or handling of a ball. A first version includes a ball attached by a tether to a vertical pole. The pole and tether limit the ball's freedom and allows the ball to rotate about the pole and return to a trainee after being struck by the trainee. A second version provides a frame mounted on the pole whereby the tether is attached to a top section of the pole. A third version includes a frame that rotates about the pole and may accept a plurality of tether attachments. Another version includes a single or double loop attached to the ball through which the tether extends. Yet another version includes a harness that encircles a ball. The ball may be a soccer ball, a baseball, a volleyball, an American football, a medicine ball or a basketball.

17 Claims, 12 Drawing Sheets

SPORT TRAINING APPARATUS

FIELD OF THE INVENTION

The present invention relates generally to sports training. The present invention more particularly relates to training methods and equipment employed to develop skills related to the control of the placement and movement of a ball.

BACKGROUND OF THE INVENTION

The professional and amateur sports industries in the United States alone generate multibillion dollars of revenues per annum. The financial position of a particular sports team or an athlete is usually closely determined by the success of the team or individual in sports competitions. The introduction, therefore, of new techniques and equipment that increase an individual athlete's or a team's competitive performance can therefore be of great value to numerous firms and sports participants.

Soccer, for example, is a sport that has overwhelming global appeal which transcends national, cultural, religious, and gender boundaries, as well as socioeconomic class. Soccer's appeal continues to grow with an ever-expanding audience through out the world in both industrialized and developing countries.

Estimates suggest that there are over 240 million registered soccer players worldwide with fan participation in the billions. The Federation Internationale de Football Association (FIFA), serves as the international governing body of soccer. FIFA is composed of both men's and women's clubs from around the globe, which are organized and compete within a worldwide soccer league. Founded in 1904 in Paris France, FIFA is currently made up of 205 member associations with over 300,000 clubs and 240 million players from around the world.

The international economic value of improved training methods and equipment for soccer players alone is quite significant.

The principal objective of the present invention is to provide a method and equipment that may be applied to sponsor the development of skills beneficial for athletic performance in ball based sports. This and other objectives of the invention will be apparent to those skilled in this field from the following description of examples and aspects of the invention.

SUMMARY OF THE INVENTION

Towards this object and other objects that will be made obvious in light of this disclosure, a first example of the present invention includes a vertical pole with at least one adjustable attachment rotatably connected to a vertical pole which additionally contains at least one tether to which at least one ball attachment is coupled. The first example (hereafter "first apparatus") may be coupled with a base weight for stability. The adjustable tether attachment is coupled to the vertical pole by means of a bearing or a tether loop.

Certain alternate examples of the present invention comprise one or more of the aspects of (1.) a vertical pole of variable height; (2.) a tethered attachment with a variable number of tethers and at least one rotational axis; (3.) a ball attachment each coupled to a tether; (4.) an outside fixture attachment coupled to a tether; and (5.) a ball attachment coupled to a tether, opposite a tether-tether attachment.

Certain still alternate examples of the present invention comprise a harness, fabric, and/or flexible strips that attaches to a ball and enables the ball to be rotatably coupled with a at least temporarily stable object, such as a pole driven into the ground or secured by a base plate.

Certain yet alternate examples of the present invention comprise one or more strips of material attached to an exterior of a round ball, whereby a line rotatably attached to a pole or an attachment point, whereby the ball may struck by a trainee at a first location relative to the ground, and the ball will then rotate about the pole or attachment point and return to the first location.

INCORPORATION BY REFERENCE

U.S. Pat. Nos. 5,823,895, 6,352,484, 6,475,108, 6,716,119, D506233, D563495, 6,220,974, 5,435,572 and 5,280,922 are incorporated herein by reference and for all purposes. In addition, each and all publications, patents, and patent applications mentioned in this specification are herein incorporated by reference to the same extent, in their entirety and for all purposes, as if each individual publication, patent, or patent application was specifically and individually indicated to be incorporated by reference.

BRIEF DESCRIPTION OF THE DRAWINGS

These, and further features of the invention, may be better understood with reference to the accompanying specification and drawings depicting the example, in which.

DETAILED DESCRIPTION

In describing aspects of the invention, certain terminology will be utilized for the sake of clarity. Such terminology is intended to encompass the recited example, as well as all technical equivalents, which operate in a similar manner for a similar purpose to achieve a similar result.

Figure 1:
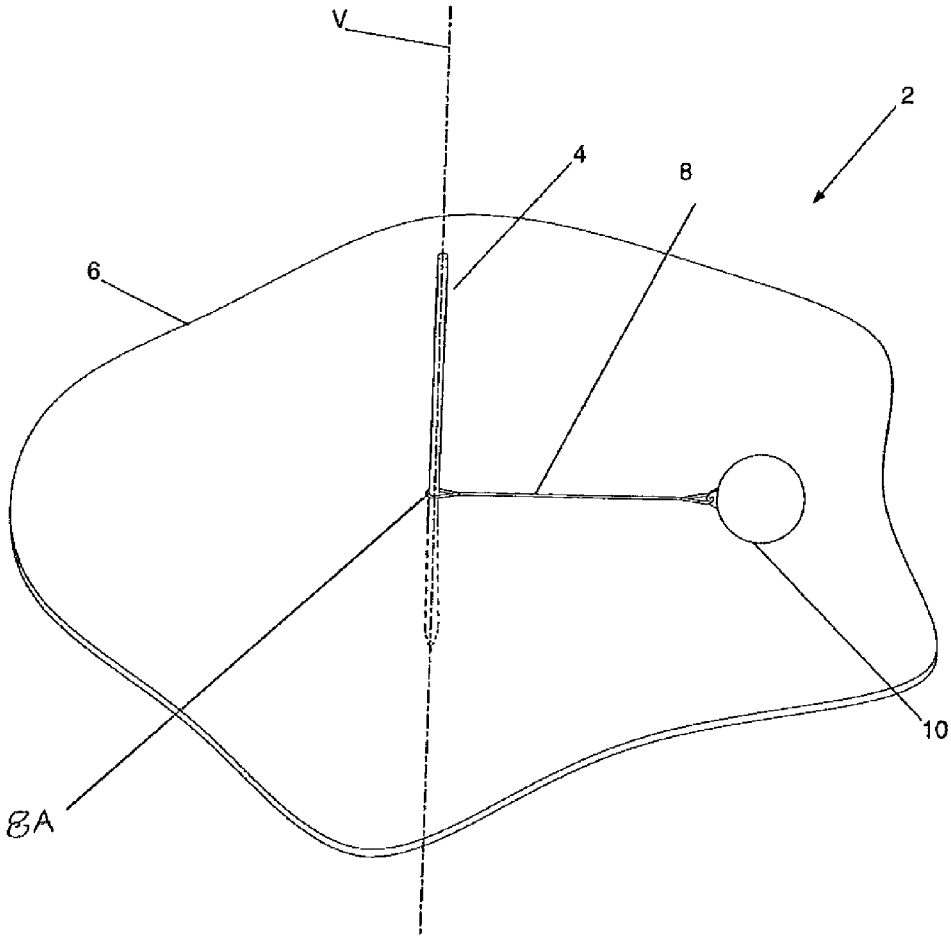
FIG. 1 is a side view of a first example of the present invention designed in accordance with the method of the present invention (hereafter, "first apparatus") as attached to the ground.

Referring now generally to the Figures and particularly to FIG. 1, FIG. 1 is a side view of the first apparatus 2 as attached to the ground 6. The first apparatus 2 comprises a stable vertical pole 4 with a height ranging from three inches to twelve feet that can be optionally imbedded into the ground 6 or stabilized by other means known within the art, a tether 8 having both a base attachment feature 8A which has freedom of movement about the vertical pole 4, and a ball attachment feature 8B which would be adaptable to different methods of connection with a ball 10. The tether 8 of the first apparatus 2 is free to move about the vertical axis V of the vertical pole 4 and may move freely up and down this axis V. The tether 8 can optionally be configured to a chosen specified rigidity and would have a length of between three inches and twelve feet. The ball 10 may be struck by a trainee to cause the ball to rotate around the pole 4 and return to the position at which the ball 10 was struck by the trainee.

Figure 2:
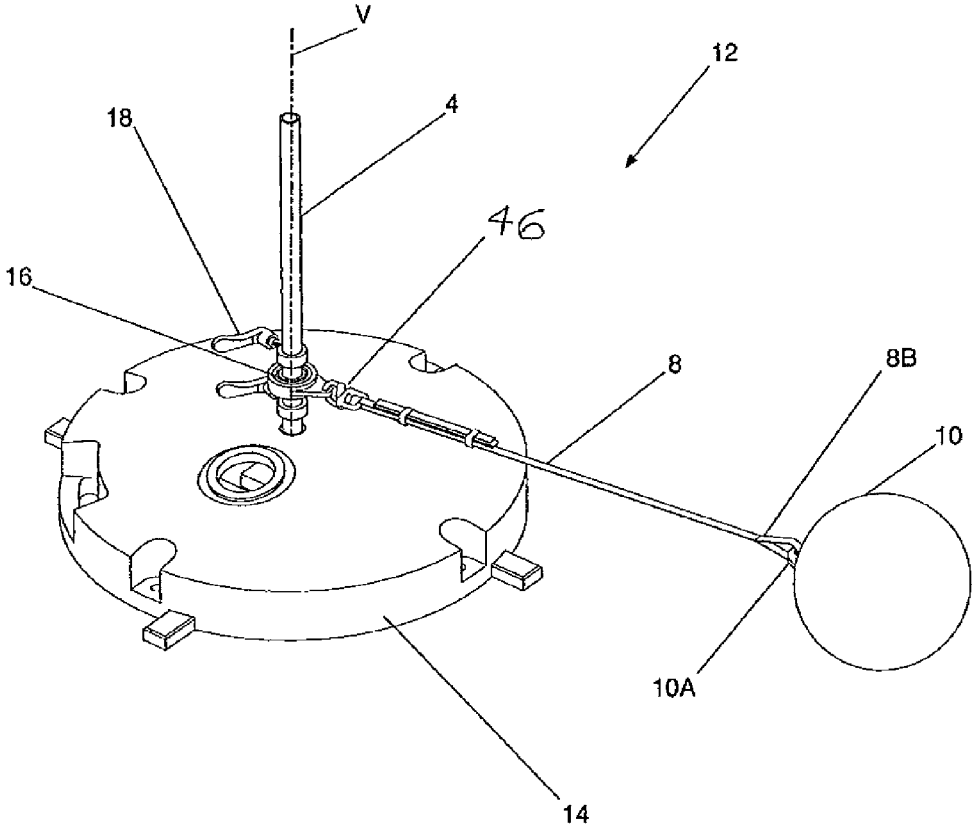
FIG. 2 is a side view of a second alternate example of the present invention (hereafter, "second apparatus") comprising a base plate.

Referring now generally to the Figures and particularly to FIG. 2, FIG. 2 is a side view of a second example 12 of the present invention compromising an adjustable tether 8. The vertical pole 4 of FIG. 1 is implemented in the second example 12 and is shown stabilized by a weighted base plate 14. The adjustable tether 8 of the second apparatus 12 is allowed to rotate freely about the vertical axis V by means of a bearing mechanism 16 having a swivel bracket 46, and is then vertically constricted to a user chosen height by at least one locking bracket mechanism 18. The tether can optionally be configured to a chosen specified rigidity and may optionally have a length of between three inches and twelve feet. The tether 8 includes the base attachment loop 8A, as shown in FIGS. 1, 3, 4 and 5, that detachably couples the tether 8 to the swivel bracket 46 of the bearing mechanism 16, or alternately encircles the vertical post 4 as shown in FIG. 1, and the ball attachment feature 8B that couples the tether 8 to a ball loop 10A of the ball 10. The ball loop 10A may comprise fabric, cloth or fabric and presents an aperture 10B through which the tether 8 extends.

Figure 3:
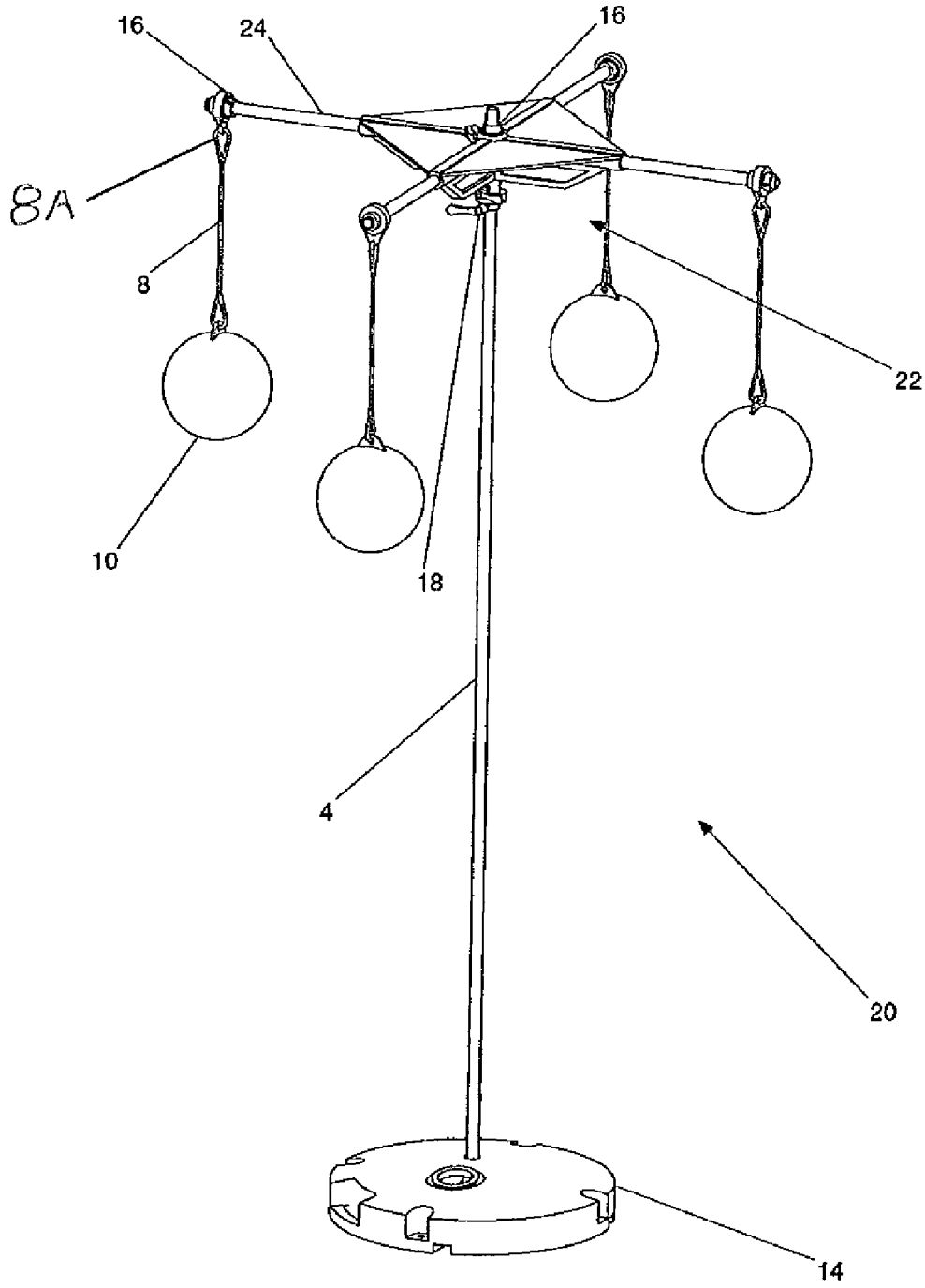
FIG. 3 is a view third alternate example of the present invention (hereafter, "third apparatus") compromising a more complex adjustable tether apparatus.
Figure 4:
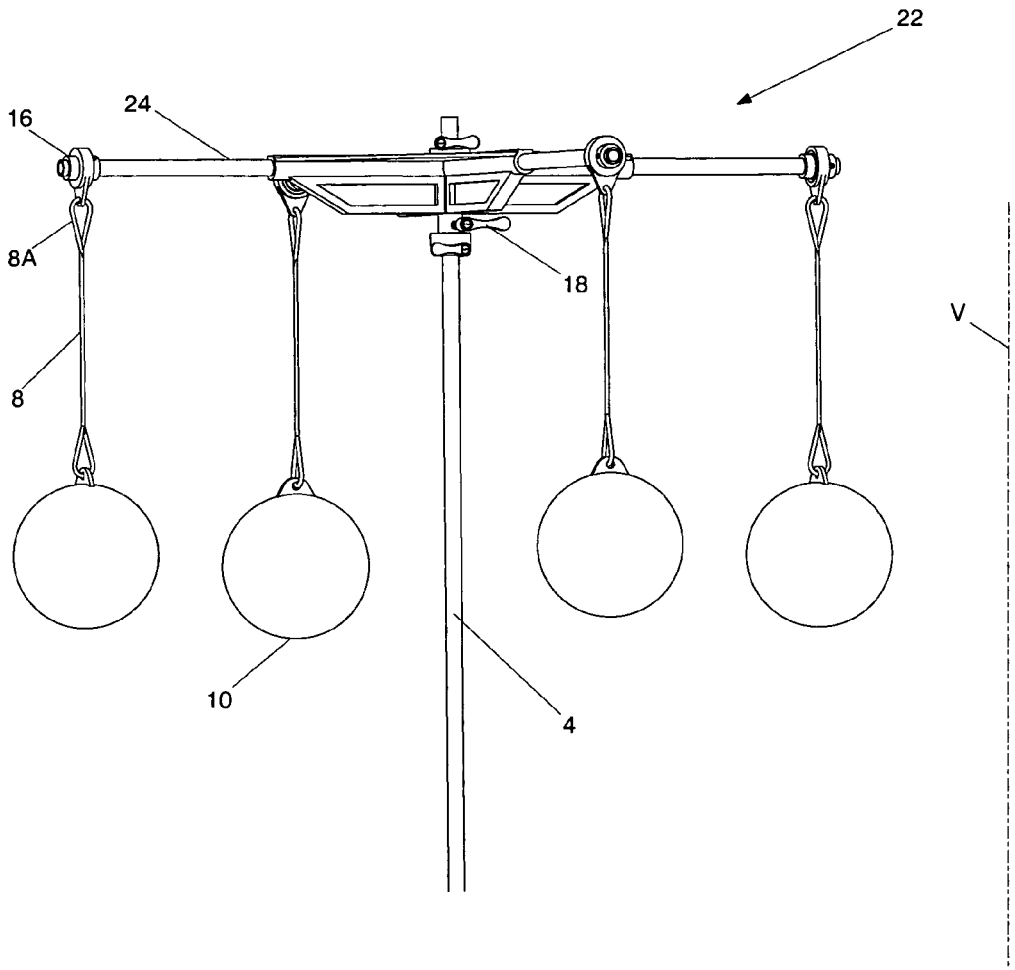
FIG. 4 is a straight on side view of the third apparatus of FIG. 3.

Referring now generally to the Figures and particularly FIGS. 3 and 4, FIG. 3 is an isometric view of a third alternate example 20 of the present invention (hereafter, "third apparatus") compromising a more complex adjustable tethers 8. FIG. 4 is a straight on side view of the third apparatus 20 of FIG. 3. The third apparatus 20 is comprised of a vertical pole 4 with a height ranging from three inches to twelve feet in height pictured stabilized by a weighted base 14, and a rotatable frame 22 coupled to a variable number of balls 10. The frame 22 of the third apparatus 20 may freely rotate around the vertical axis V by means of a bearing mechanism 16, and then is vertically constricted to a user chosen height by at least one locking bracket mechanism 18. Additionally the frame 22 of the third apparatus 20 includes one or more horizontal shafts 24 that extend outwards from the vertical pole. At the end of each horizontal shaft(s) 24 a tether 8 can optionally be attached and configured to a chosen specified length \between three inches and twelve feet extends from a bearing joint 16 of the coupled horizontal shaft 24. The bearing joint 16 allows the tether 8 free movement about the axis of the coupled horizontal shaft 24, but is at a fixed location at the end the coupled shaft 24 that limits horizontal motion of the base attachment feature 8A relative to the pole 4. Each attached ball 10 is coupled to a ball attachment feature 8B of one and only one tether 8.

Figure 5:
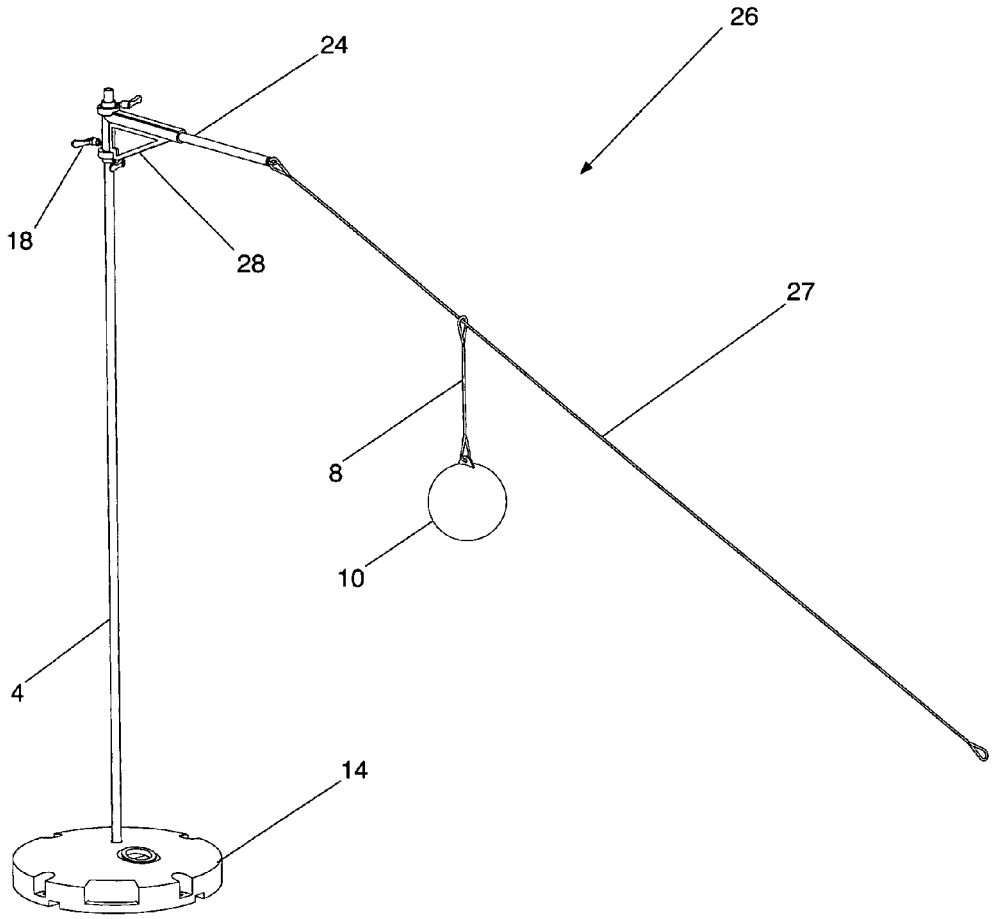
FIG. 5 is a side view of a fourth alternate example of the present invention (hereafter, "fourth example") that includes an adjustable tether attachment that can optionally attach to an exterior fixture.

Referring now generally to the Figures and particularly to FIG. 5, FIG. 5 is a side view of a fourth alternate of an alternate example of the present invention 26 (hereafter, "fourth example") that includes an extending line tether 27 that can optionally attach to an exterior fixture (not shown). The fourth apparatus 26 makes includes the vertical pole 4 preferably establishing a distance (i.e., "height") between three inches to twelve feet extending between the base plate 14 and frame 22. This pole 4 is stabilized by the weighted base plate 14 or by any other known stabilization methods known in the art. Affixed to the vertical pole 4 is an outstretched line attachment arm 28. This attachment arm 28 is constricted to a user chosen height and angle by use of at least one locking bracket mechanism 18. The attachment arm 28 includes at least one horizontal shaft 24 outstretched from the locking bracket(s) 18 to which one end of the line 27 is affixed. On the opposing end of the 27 is an exterior fixture line attachment 27A that may be affixed or tied to an external stable structure (not shown), such as a wall or a bracket. The line 27 can optionally be configured to a chosen specified rigidity and may have a length of between three inches and fifty feet. Coupled to the length of the line 27, a tether 8 may hang freely able to travel along the line 27 congruently. This hanging tether 8 would then have a variable ball attachment 10 affixed to the opposite end.

Figure 6:
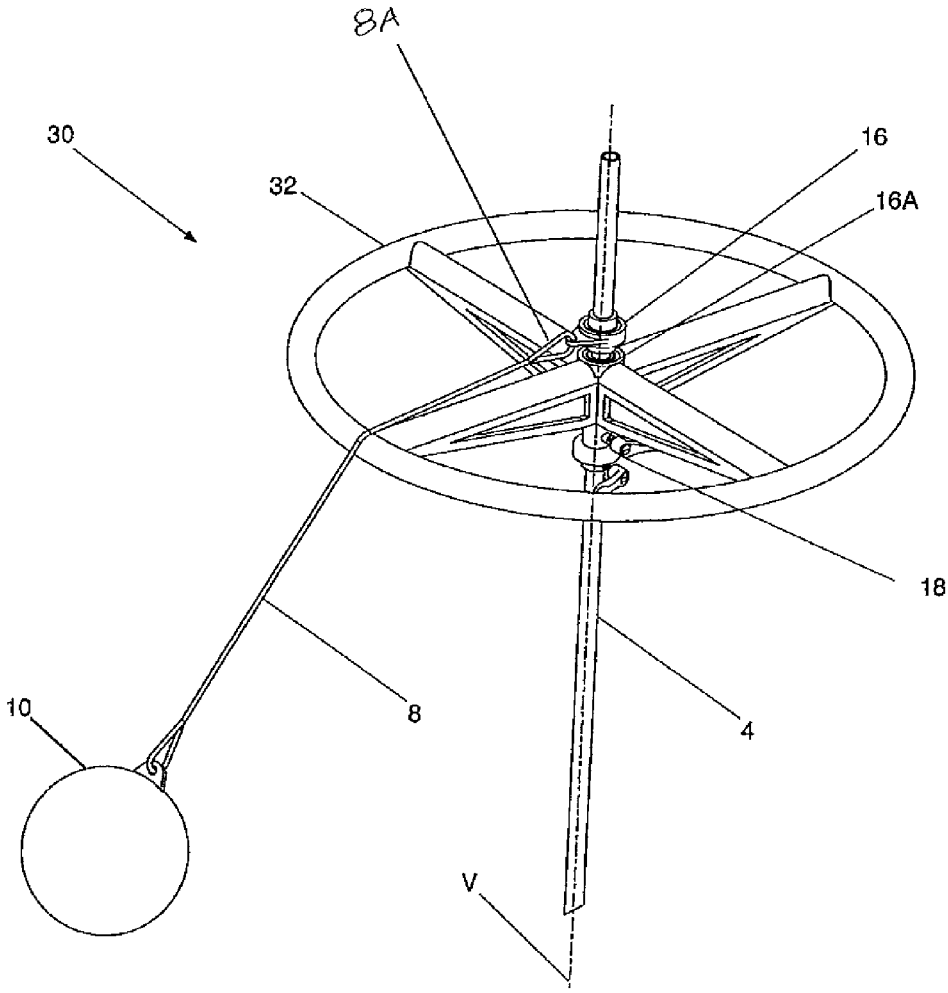
FIG. 6 is a side view of a fifth alternate example of the present invention (hereafter, "fifth apparatus") that includes an adjustable, circular, tether attachment.

Referring now generally to the Figures and particularly to FIG. 6, FIG. 6 is a side view of a fifth alternate example 30 of the present invention (hereafter, "fifth apparatus") that includes an adjustable, circular, tether attachment 32. The fifth apparatus 30 is comprised of a vertical pole 4 with a height ranging from six inches to twelve feet in height and is stabilized by a weighted base 14, and an adjustable, circular, tether attachment 32 with a number of user selectable settings. The circular attachment 32 of the fifth 30 apparatus may freely rotate around the vertical axis V of the pole 4 by means of a bearing mechanism 16, and then is vertically constricted to a user chosen height displacement between the base plate 14 and the frame 24 by at least one locking bracket mechanism 18. The movement along the vertical axis V can also be restricted by means of a locking bracket mechanism 18A coupled with the bearing mechanism 16A. Additionally a tether 8 extends from the center of the attachment ring 32 that is free to rotate about the central axis by means of a bearing 16 and is affixed just above the ring 32. On the opposing end of the tether 8 a variable ball attachment 10 may be affixed. The tether 8 is draped over the ring attachment 32 and movement of the tether 8 is thus restricted to be a minimum distance from the vertical pole 4 by the radius of the circle 32.

Figure 7:
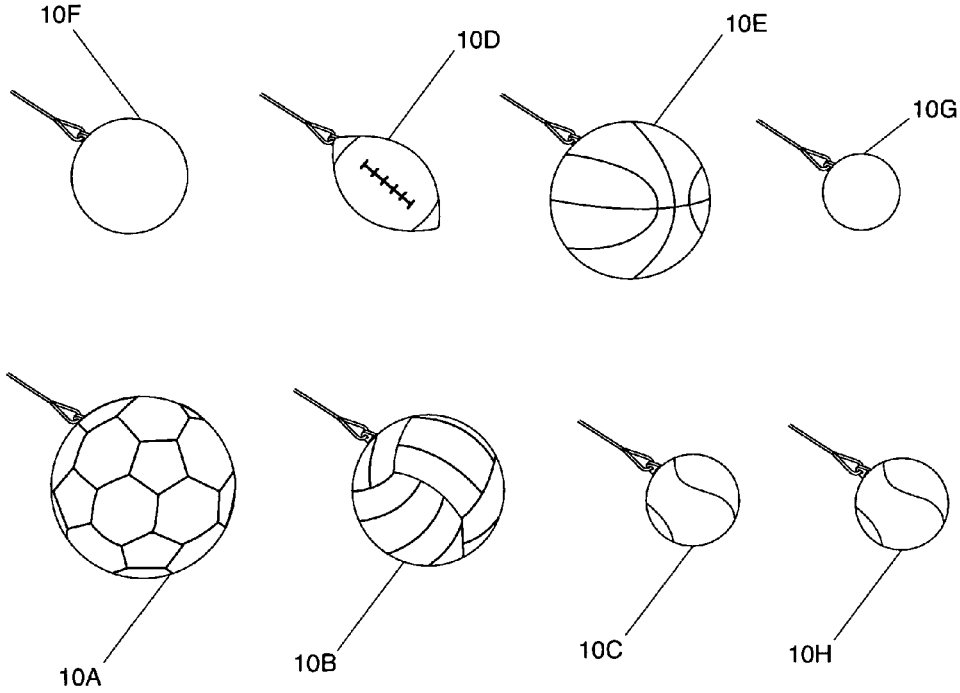
FIG. 7 is a view of a sixth alternate example of the present invention that includes multiple ball based tether attachments for optional use of different ball types.

Referring now generally to the Figures and particularly to FIG. 7, FIG. 7 is a view of a sixth alternate example of the present invention that includes multiple ball based tether attachments 10 for optional use of different ball types. Various alternate examples of the present invention may be adapted to training for multiple sports and can use interchangeable ball attachments 10. They commonly could be swapped for but would not be limited to; (1.) a soccer ball 10A; (2.) a volleyball 10B; (3.) a baseball 10C; (4.) an American football 10D; (5.) a basketball 10E; and (6.) a medicine ball 10F.

Figure 8:
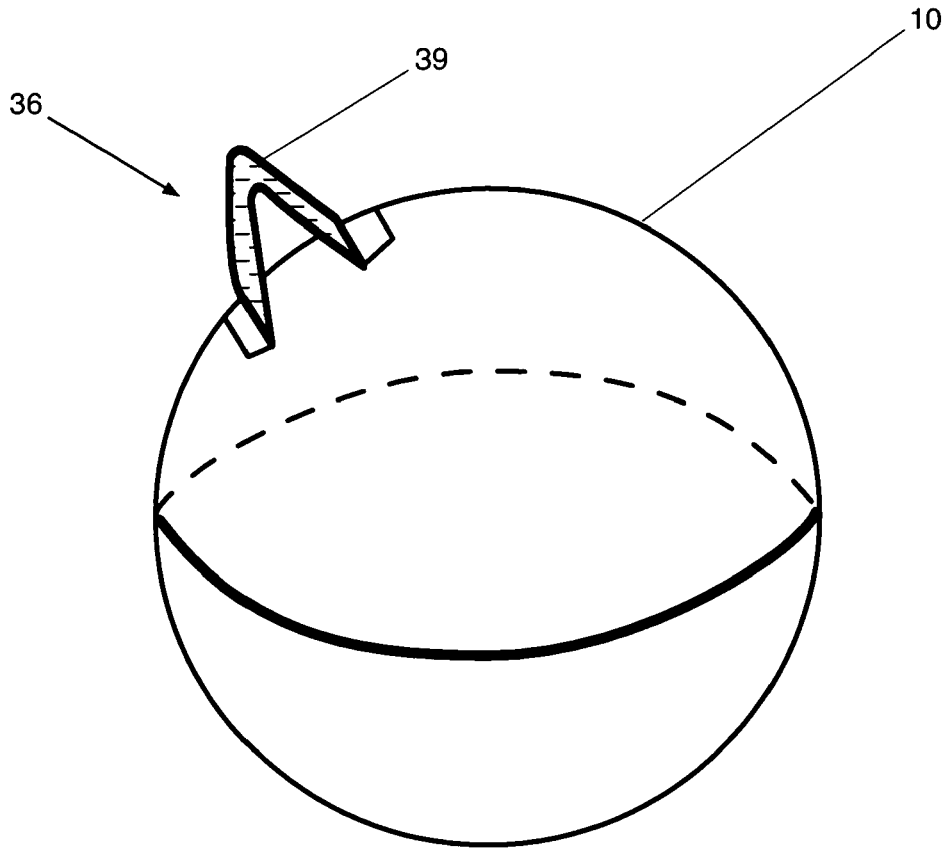
FIG. 8 is a side view of a first example of a ball attachment device including one sown-on loop attachment.

Referring now generally to the Figures and particularly to FIG. 8, FIG. 8 is a side view of a first example of a pre attached loop 36 of a ball 10 using a single length of material 39. In this first loop 36 the material 39 may be glued, or sewn on to the ball's external surface, and/or affixed to the ball 10 by other suitable means known in the art. The first loop 38 is used to fasten the variable length of the tether 8 to the ball 10.

Figure 9:
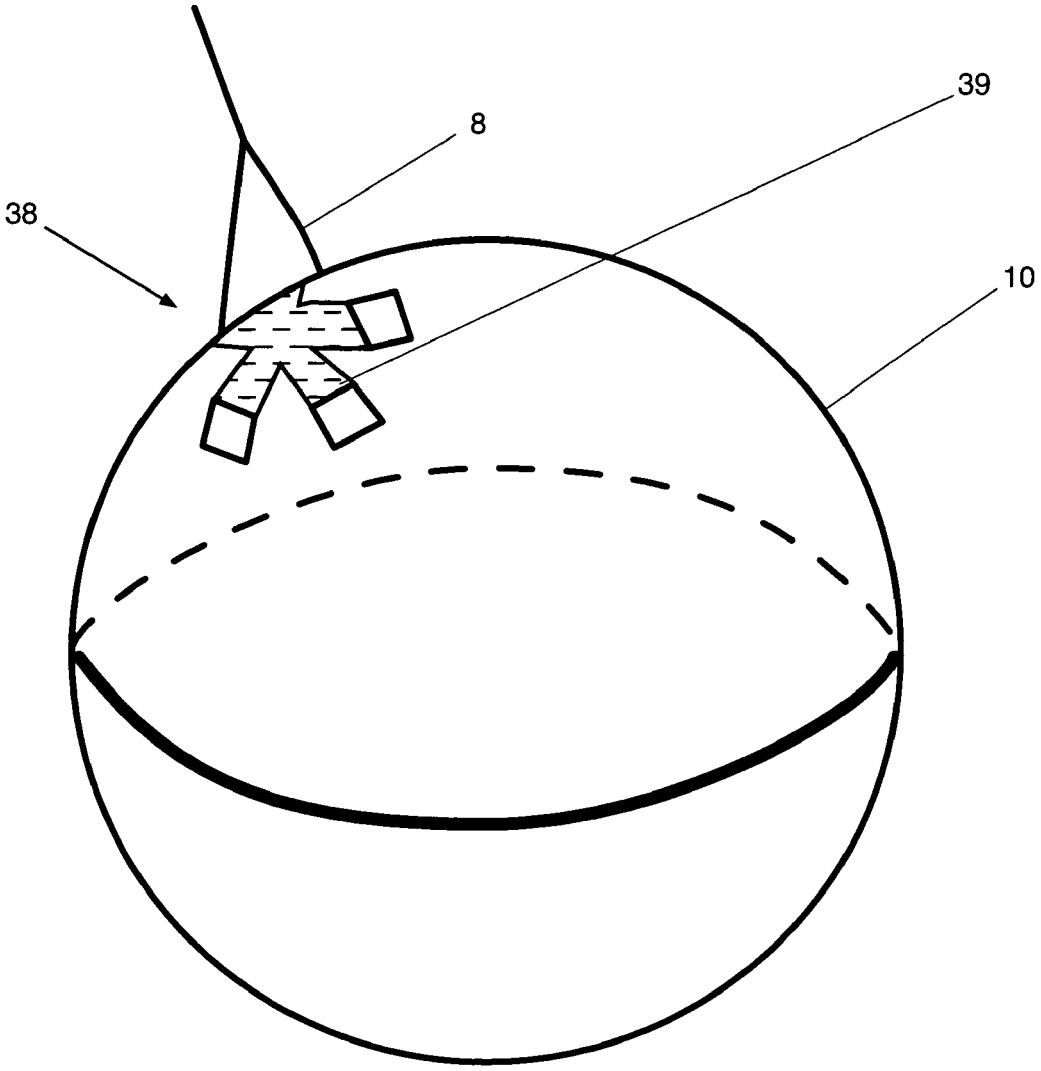
FIG. 9 is a side view of a second example of a ball attachment device using a sewn-on, double loop attachment.

Referring now generally to the Figures and particularly to FIG. 9, FIG. 9 is a side view of a second loop 40 (or "double loop" 40) includes a double loop of the material 39. In this second loop 40 the material 39 is glued, or sewn on to the ball, and/or affixed to a ball 10 by other suitable means known in the art. This double loop 40 is used to fasten the variable length of tether 8 to the ball 10 and can provide additional stability from the single loop 38.

Figure 10:
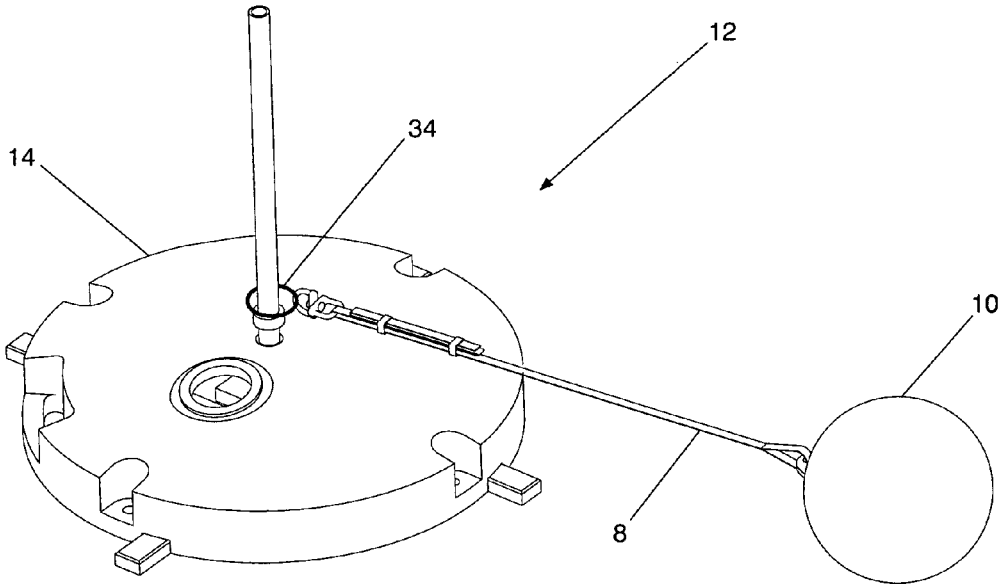
FIG. 10 is a side view of the second example of the sports training apparatus with a simple tether loop to fasten to the vertical pole.

Referring now generally to the Figures and particularly to FIG. 10, FIG. 10 is a side view of the second example 12 of the sports training apparatus with a simple tether loop 34 used to fasten to the vertical pole 4. The tether loop 34 allows for a possibility to attach the length of tether 8 to one of the trainee's limbs, i.e., a leg or an arm. The tether loop 34 can be composed of any suitable material known in the art.

Figure 11:
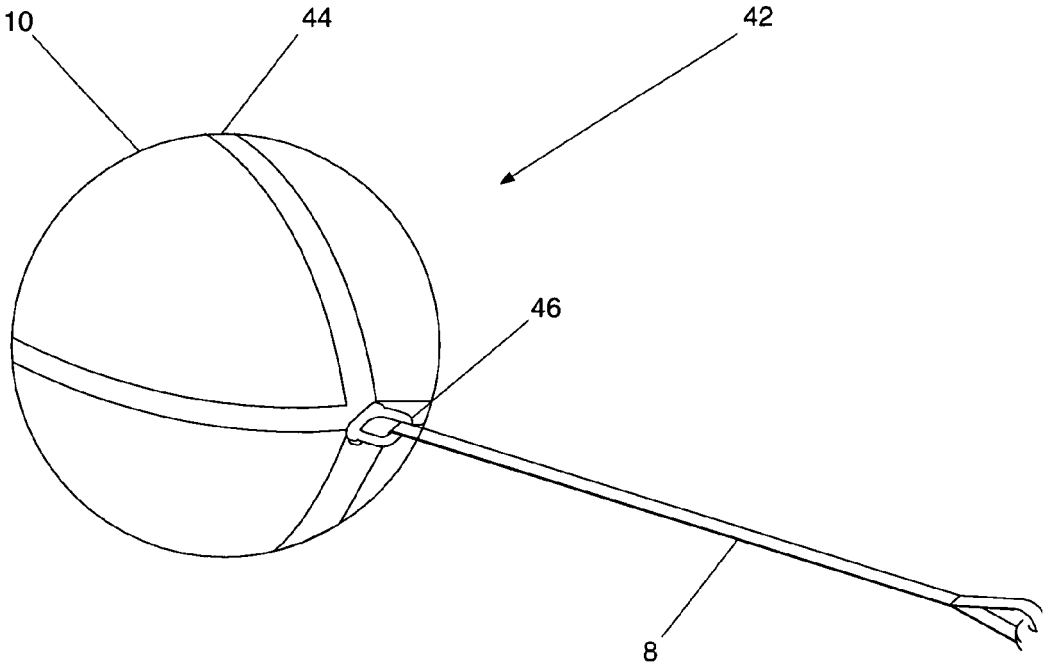
FIG. 11 is a view of a third example of a ball attachment device using a harness to attach to a separately obtained ball.
Figure 12:
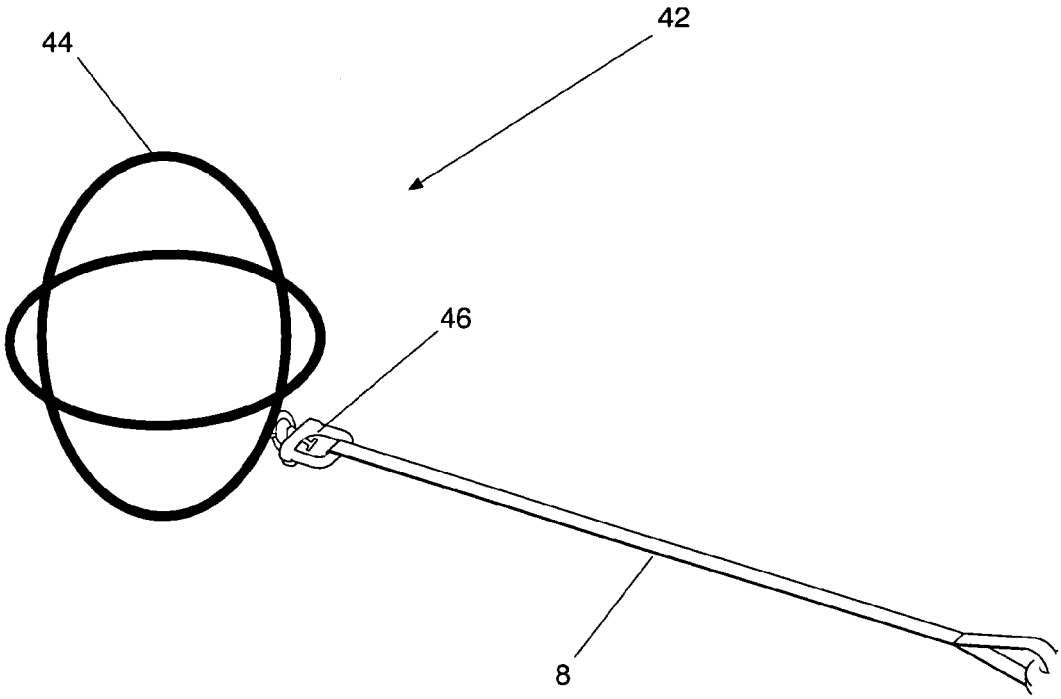
FIG. 12 is a view the harness of FIG. 11.

Referring now generally to the Figures and particularly to FIGS. 11 and 12, FIG. 11 is a view of a third example of a ball attachment 42 using a harness 44 configured to attach to a separately obtained ball 10; while FIG. 12 is a view of a third example of a ball attachment 42 using a harness 44 to attach a ball. In this third example 42, one end of the length of tether 8 will be fastened to a harness 44 which can optionally employ a swivel bracket 46 that allows the ball 10 to spin freely without twisting the length of tether 8. The harness 44 secures a separately obtained ball 10 that would not need a pre fixed loop 38 or double loop 38A, to attach to the length of tether 8. The harness 44 can optionally be made of the same material as the length of tether 8. The harness 44 could optionally be composed with or of a single sided adhesive material to provide a sturdier bond to the ball 10.

The foregoing disclosures and statements are illustrative only of the Present Invention, and are not intended to limit or define the scope of the Present Invention. The above description is intended to be illustrative, and not restrictive. Although the examples given include many specificities, they are intended as illustrative of only certain possible examples of the Present Invention. The examples given should only be interpreted as illustrations of some of the examples of the Present Invention, and the full scope of the Present Invention should be determined by the appended claims and their legal equivalents. Those skilled in the art will appreciate that various adaptations and modifications of the just-described examples can be configured without departing from the scope and spirit of the Present Invention. Therefore, it is to be understood that the Present Invention may be practiced other than as specifically described herein. The scope of the present invention as disclosed and claimed should, therefore, be determined with reference to the knowledge of one skilled in the art and in light of the disclosures presented above.

What is claimed is:

1. A sports training apparatus, comprising:

a plurality of balls;

a plurality of tethers, each tether having a first tether end and a second tether end, wherein each of said plurality of tethers coupled to one ball of the plurality of balls at the first tether end and configured to constrain the movement of the coupled ball;

a vertical pole a height adjustable attachment element rotatably coupled with the vertical pole; and a plurality of arms, each arm having an inner end and an outer end, the second tether end of one tether of the plurality of tethers attached to each outer arm and each arm coupled to the height adjustable attachment element, whereby each ball is rotatably coupled to the vertical pole at an adjustable vertical height and each arm at least partially supports a weight of one ball.

2. The sports training apparatus of claim 1, further comprising:

a pole, the pole configured for substantially upright insertion into a ground plane;

a lower tether having a pole end loop and a ball end, the pole end loop rotatably encircling the pole; and a lower ball, the lower ball comprising a ball loop, the ball loop coupled to the ball end of the tether, whereby the lower ball is constrained by the lower tether after the lower ball is struck by a trainee, and the pole end loop enables the lower tether to fully rotate about the pole.

3. The sports training apparatus of claim 2, wherein the lower ball is a soccer ball.

4. The sports training apparatus of claim 1, wherein the vertical pole has a linear height in the range from three inches to twelve foot.

5. The sports training apparatus of claim 1, wherein the vertical pole has a linear height in the range from three inches to one foot.

6. The sports training apparatus of claim 2, wherein the ball end of the lower tether is coupled with the lower ball by stitching.

7. The sports training apparatus of claim 2, wherein the ball end of the lower tether is detachably coupled with the lower ball.

8. The sports training apparatus of claim 2, wherein the lower tether has a linear length in the range of from six inches to twelve feet.

9. The sports training apparatus of claim 6, wherein the lower ball is a soccer ball.

10. The sports training apparatus of claim 1, further comprising a base plate configured to receive the vertical pole and maintain the vertical pole in a substantially upright position.

11. The sports training apparatus of claim 1, wherein at least one ball is selected from the group consisting of a volleyball, a baseball, an American football, a basketball and a medicine ball.

12. The sports training apparatus of claim 1, wherein at least one tether is adjustable in length in a range of six inches to twelve feet.

13. The sports training apparatus of claim 1, wherein the vertical pole has a linear height in the range of six inches to twelve feet.

14. The sports training apparatus of claim 1, further comprising a base plate configured to receive the vertical pole and maintain the vertical pole in a substantially upright position.

15. The sports training apparatus of claim 1, further comprising an extension arm, wherein the extension arm is attached to the vertical pole and the pole end of the second tether end of at least one tether is rotatably coupled to the extension arm.

16. The sports training apparatus of claim 1, wherein the extension arm is rotatably attached to the pole and the extension arm comprises further comprising a circular rim supported by a plurality of rotatable rigid radials extending from the vertical pole, wherein the circular extension arm is vertically constricted to a user selectable height.

17. The sports training apparatus of claim 16, further comprising a plurality of tethers and a plurality of balls, wherein pole end of each at least one second tether end is rotatably coupled to the circular arm, and each ball is coupled with a single tether.

* * * * *